United States Patent [19]

Cleland

[11] Patent Number: 4,544,084

[45] Date of Patent: Oct. 1, 1985

[54] BEVERAGE DISPENSER

[76] Inventor: Robert K. Cleland, 11051 Via El Mercado, Los Alamitos, Calif. 90720

[21] Appl. No.: 623,615

[22] Filed: Jun. 22, 1984

Related U.S. Application Data

[63] Continuation of Ser. No. 327,249, Dec. 3, 1981, abandoned.

[51] Int. Cl.[4] ..... B67D 1/08; B67D 5/56

[52] U.S. Cl. ..... 222/56; 222/64; 222/129.2; 137/892

[58] Field of Search ..... 222/56, 64, 641, 129.1, 222/129.2, 129.3, 129.4, 145; 99/275; 366/142, 153; 137/892, 893, 263, 392, 393

[56] References Cited

U.S. PATENT DOCUMENTS

| | | | |
|---|---|---|---|
| 3,108,718 | 10/1963 | Seener | 222/145 X |
| 3,253,741 | 5/1966 | Russell et al. | 222/64 X |
| 3,521,791 | 7/1970 | Freise | 222/64 |
| 3,876,107 | 4/1975 | Meindl et al. | 222/64 |
| 3,976,222 | 8/1976 | Spagnolo | 222/641 |
| 4,042,151 | 8/1977 | Uttech | 222/129.2 |
| 4,160,512 | 7/1979 | Cleland | 222/56 |

FOREIGN PATENT DOCUMENTS

| | | | |
|---|---|---|---|
| 2069458 | 8/1981 | United Kingdom | 222/129.2 |

*Primary Examiner*—Joseph J. Rolla

*Assistant Examiner*—Kevin P. Shaver

*Attorney, Agent, or Firm*—Georges A. Maxwell

[57] ABSTRACT

A self-contained unitary attachment engageable atop the supply tank of a beverage dispensing machine in place of the standard cover therefore. The attachment includes a liquid concentrate reservoir that depends into the beverage in the tank and up into a housing portion of the attachment. The housing portion of the attachment accommodates a proportional mixing device with inlets connected with the reservoir and a pressure water supply and an outlet communicating with the tank, a valve to start and stop the flow of water, a pressure regulator related to the water supply, liquid level sensors responsive to high and low liquid levels in the tank, a signalling device to signal when the reservoir is substantially empty of concentrate and a control circuit connected with the valve and liquid level sensors whereby the valve is opened and closed to maintain the liquid level in the tank between high and low levels. The attachment can be engaged with and removed from a related dispensing machine without modification or alteration of the machine. The attachment only has a single water supply line and a single electric supply cord extending from it to releasably connect with a pressurized water supply and a power supply. The housing portion has a normally closed opening above the reservoir to effect intermittent filling of the reservoir with concentrate.

8 Claims, 8 Drawing Figures

BEVERAGE DISPENSER

This application is a continuation of application Ser. No. 327,249, filed Dec. 3, 1981, now abandoned.

This invention has to do with a non-carbonated beverage dispensing machines and is particularly concerned with an automating adapter unit for such machines.

BACKGROUND OF THE INVENTION

In the art of vending and dispensing beverages, the prior art has developed and provides special machines for the handling of different classes of beverages. In the case of non-carbonated, fruit-flavored beverages, such as orange, lemon and grape flavored beverages, the prior art provides counter-top machines which comprise box-like bases intended to be engaged and supported atop a counter or the like and which carry upwardly projecting beverage supply tanks. The bases of such machines normally have manually operable beverage dispensing valves or spigots projecting therefrom and house refrigeration systems and recirculating pump means to chill or cool and to circulate the beverage in the supply tanks. In most machines of the character referred to, the tanks have bottom walls formed with downwardly opening cavities in which evaporator coils or units of the refrigeration systems are engaged to effect cooling of the beverage in the tanks and on which pumps of the recirculating pump means are mounted or through which fluid-conducting parts of said pump means are engaged. Finally, the machines of the class here concerned with are provided with substantially flat, horizontal covers removably engaged over and closing the upper ends of the supply tanks.

Machines of the character referred to above have become substantially standardized and while the details of construction and design of machines produced by each manufacturer differ from machines of other manufacturers, all of such machines are essentially alike as regards their general combination and relationship of parts.

In operation and use of machines of the character referred to above, beverage to be vended and dispensed is manually poured into the tanks, at the open tops thereof, from suitable mixing pots or vessels.

The beverages commonly vended and dispensed by the above-noted class of machines will be made up or reconstituted by combining predetermined measured volumes of liquid beverage extract or flavored syrup and water. In those machines which include recirculating pump means, efforts have been made to pour the measured volumes of water and syrup into the tanks of the machines and thereafter let the pump means effect desired mixing of those ingredients, but such practice has proven to be unsatisfactory.

In the recent past, to avoid the inconvenience and many problems attending the manual filling of the supply tanks of beverage dispensing means in the manner noted above, the art has provided proportional mixing means to automatically mix water and syrup together and to deliver the resulting beverage into the supply tanks. In the overwhelming majority of instances, the proportional mixing means include aspirator units with water supply means to connect with pressurized water systems, syrup supply means to connect with supplies of syrup, and delivery means to deliver beverage into the supply tanks of related machines. In addition to the foregoing, the noted proportional mixing means have been provided with electrically operated valves for the water supply means and liquid level responsive switching means positioned within the supply tanks of the machines to control said valve means whereby the supply of beverage in the tanks is maintained above a desired minimum level at all times.

To date, to the best of my knowledge and belief, the above noted proportional mixing means which serve to automate their related beverage machines have consisted of various attachments and are provided in kit form. Their principal components are arranged at the exterior of their related machines and are such that to connect or relate them with the machines requires the drilling of holes and the performing of other modifying work on or within the machines. The work which must be performed on the machines is such that it requires the exercise or special skills and is such that if often spoils the aesthetics of the machines.

The principal utilitarian or functional shortcomings found to exist in the above noted proportional mixing means provided by the art resides in the fact that the supplies of syrup at the exterior of and separate from the machines must, for real and practical reasons, be placed on shelves or within cabinets below the counters or the like on which the machines are supported. Accordingly, the supplies of syrup occur a substantial distance below the mixing units and the supply tanks of the machines and must be connected with the mixing means with elongate, troublesome and unattractive hoses or the like. The special relationship and vertical displacement of the syrup supplies, mixing units and supply tanks results in the delay of flow of syrup and in the establishment of head pressures in the systems which often result in adverse effects. The most commonly encountered adverse effect is the inability of the mixing means to effectively draw and deliver desired volumes of syrup and results in improperly proportioned volumes and syrup and water.

It is to be noted that while the mixing means provided by the prior art and described in the foregoing can be made to operate satisfactorily in test stand installations where the most effective placement of parts can be effected, such placement of parts can seldom be established in practice where the machines must be set atop counters in restaurants and the like and where the supplies of syrup must be hidden from view and are placed under the counters or in some other obscure and remote place.

A serious shortcoming to be found in prior art machines of the character referred to above resides in the fact that when the supplies of syrup are exhausted, the proportional mixing means continue to operate and deliver water into the supply tanks, diluting the beverage therein.

Another shortcoming found to exist in beverage dispensing machines of the character referred to above resides in the fact that the refrigeration systems incorporated therein are low capacity systems which cannot cool or chill a new supply of beverage in a short period of time. Accordingly, when it becomes necessary to refill or replenish the supplies of beverage in such machines, the new supplies of unchilled beverage must be let to stand a protracted period of time to become adequately chilled and before they are ready to be dispensed. To reduce the effect of this serious problem, the supply tanks are made to hold larger than desired volumes of beverage and recommendations are made to replenish the supplies of beverage regularly and before they are depleted to an appreciable extent so that the added new beverage does not warm the remaining supply of beverage excessively.

Another problem found to exist in the use of prior art aspirator type mixing units resides in the fact that the density and viscosity of some beverage syrups changes substantially in response to changes in temperature. As a result of the foregoing, when separate and remote syrup supplies are stored in places where their temperatures are subjected to substantial changes, the rate at which the aspirators can move the syrup and the ratio of syrup and water delivered by the units is subject to corresponding changes. For example, in the cool of the morning, and before a separate and remote syrup supply for a machine is warmed up, the syrup is likely to be thick and slow flowing, while in the heat of the day and when that supply of syrup is warmed up, the syrup is likely to be thin and fast flowing. In such a case, beverage mixed in the morning is likely to be excessively weak and beverage mixed later in the day is likely to be excessively strong.

Finally, in the prior art machines of the character referred to above, wherein the beverage is non-pressurized and wherein the fluid level and resulting head pressure on the beverage in the supply tanks is subject to considerable variation, those time-controlled dispensing valves which are commonly used in pressurized beverage dispensing machines and which are commonly called portion control valves cannot be used since the differences in head pressures which are encountered result in corresponding differences in the volumes of beverage dispensed during opening or cycling of those valves.

OBJECTS AND FEATURES OF THE INVENTION

An object of my invention is to provide an automating adapter unit for beverage dispensing machines which substitutes for the supply tank cover of the machine.

It is another object and feature of my invention to provide a unit of the character referred to above which includes an aspirator unit at the top of the supply tank and a syrup reservoir within the upper portion of the supply tank whereby the supply of syrup and the aspirating unit are closely related vertically and laterally or horizontally, whereby no appreciable delay of flow between the unit and the supply of syrup will result from the spatial relationship between said supply and unit and whereby no appreciable change or slowing of the flow of syrup from the supply of syrup to the unit, caused by hydrostatic pressure differentials therebetween, will occur.

Another object and feature of my invention is to provide an adapter unit of the character referred to above wherein the syrup supply reservoir extends down from the top of and into the interior of the supply tank and is immersed in the chilled beverage in the tank whereby the syrup is maintained chilled and at a substantially constant temperature and corresponding density and/or viscosity, whereby its flow rate to and through the aspirator unit is substantially constant and subject to accurate control. Further, the supply of syrup is maintained chilled so that the temperature of the beverage flowing from the aspirator into the supply tank is lowered sufficiently so as not to adversely warm the supply of beverage in the tank. Still further, the chilled supply of syrup in the syrup reservoir within the supply tank supplements the refrigeration system of the machine to lower the temprature of freshly reconstituted beverage delivered into the machine to a desired serving temperature.

Yet another object and feature of my invention is to provide a structure of the character referred to above wherein the syrup supply reservoir occupies space in the beverage supply tank to reduce the volume of beverage held thereby so that the supply of prepared beverage is reduced and is more frequently replenished by fresh beverage by automatic operation of my unit.

It is another object and feature of my invention to provide an automating adapter unit comprising a replacement cover structure for a beverage dispensing machine supply tank, which cover structure carries a syrup supply reservoir, an electric valve controlled proportional mixing unit, liquid level control means and an electric control circuit.

Another object and feature of my invention is to provide a structure of the character referred to above wherein the cover structure is an aesthetically attractive structure which houses and obscures the components and parts of the unit which are related to it and which is aesthetically complimentary with the beverage dispensing machine with which it is related.

An object and feature of my invention is to provide a structure of the character referred to above wherein the replacement cover structure is manually removable from engagement with the tank of its related beverage dispensing machine and has a top wall with an access opening, concentric with the open top of the syrup reservoir whereby the supply of syrup in the reservoir can be replenished as circumstances require. The access opening and the top of the reservoir are normally closed by a manually movable lid carried by said top wall.

Yet another object of the invention is to provide a structure of the character referred to which includes novel means to monitor the supply of syrup and to signal and put the machine out of service when the supply of syrup requires replishment.

Other objects of this invention are to provide a structure of the character referred to which is such that the delivery of water into the supply tank is shut off when the supply of syrup is exhausted and a structure wherein the supply of beverage in the supply tank is maintained at a substantially constant level whereby the head pressure of beverage in the tank and at the dispensing valve is substantially constant and such that the dispensing valve can be a portion control valve.

Finally, it is an object and feature of my invention to provide a structure of the character referred to which is such that its related dispensing machine can be easily and quickly made automatic by simple replacement of its orginal tank cover by the unit that I provide and without other alteration or modification of the machine.

The foregoing and other objects and features of my invention will be apparent and fully understood from the following detailed description of one typical preferred form and embodiment of the invention, throughout which description reference is made to the accompanying drawings.

DESCRIPTION OF THE INVENTION

Figure 1:
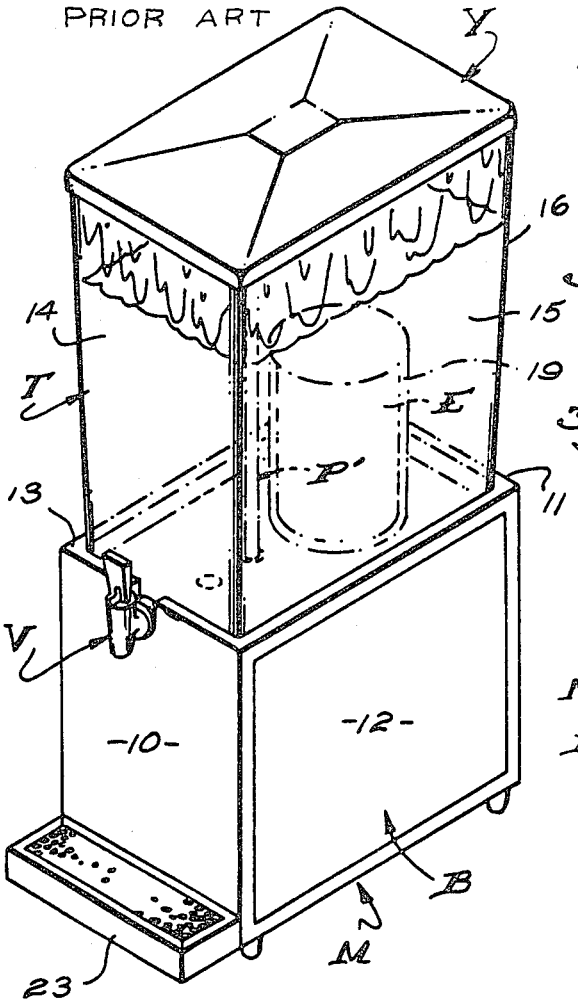
Fig. 1. PRIOR ART
FIG. 1 is an isometric view of a standard beverage dispensing machine.

In FIG. 1 of the drawings, I have shown a typical, non-carbonated beverage dispensing machine M. The machine M includes a box-like base B with vertical front, rear and side walls 10, 11 and 12, a downwardly disposed counter-engaging bottom and a horizontal tank supporting top 13. A beverage supply tank T is engaged on the top of and projects upwardly from the base B. The tank T is typical of the tanks of most beverage dispensing machines of the class here concerned with and is rectangular in horizontal cross-section. The tank has flat, substantially vertical, front, side and rear walls 14, 15 and 16, a bottom or base wall 17 and an upper rim 18 defining an open top. The bottom or base wall 17 has an upwardly projecting downwardly opening cup-like projection 19 defining a donwardly opening well or cavity 19' in which an evaporator coil or evaporator unit E, projecting upwardly from the base B, is engaged. The bottom wall also has a fitting 20 in which the lower end portion of an elongate vertical stand-pipe P' is engaged. The stand-pipe P' depends from the tank into the base B where it connects with a recirculating pump means (not shown). The upper end of the standpipe terminates and opens upwardly within the top portion of the tank T to direct beverage onto the lower side of a cover Y which normally overlies and closes the top of the tank and from which the beverage drops and/or cascades down into the tank. The bottom wall of the tank also has a fitting 21 in which the upper end of a drain pipe is engaged, which pipe depends into the base and connects with the pump means.

In some machines of the character here concerned with, the pump means includes a pump structure mounted on or incorporated in the bottom wall of the tank and which is driven by an electric motor mounted in the base B, as by means of a magnetic drive operating through the bottom wall of the tank.

In practice, the type or kind of recirculating pump means with which the machine is equipped can vary widely since it has little or no direct effect on my invention.

As shown in the drawings, the top 13 of the base B is formed to cooperatively receive and securely hold and support the lower end portion of the tank T.

The front wall 14 of the tank is provided with a delivery port, adjacent the bottom wall 17 and with which a manually operable dispensing valve V is engaged. The valve V projects forwardly from the tank, through the upper edge portion of the front wall 10 of the base B, and opens downwardly to dispense beverage into drinking glasses or the like arranged below the valve, at the front of the machine.

In practice, a drip tray 23 is positioned at and projects forwardly from the bottom of the front wall of the base.

The base B houses a refrigeration system which includes the above noted unit E. The unit E projects upwardly from the base and into the cavity 19' defined by the projection 19 in the tank.

In practice, the tank T is made of transparent material so that the beverage therein and the beverage dropping and/or cascading down from the top thereof can be observed. The foregoing is an important and an effective sales promoting feature of such machines.

The tank T is originally equipped with a substantially flat, horizontal, removable cover Y which overlies and closes the top of the tank, as shown in FIG. 1 of the drawings.

The machine M illustrated in the drawings and briefly described above is illustrative of a typical non-carbonated beverage dispensing machine provided by the prior art. The details of construction, the exact arrangement, and the proportioning of parts varies between different types and models of machines, but the basic combination and arrangement of parts in the overwhelming majority of such machines is essentially as illustrated and described in the foregoing.

In carrying out my invention, the only part and/or portion of dispensing machines which is of concern and which must be accounted for is the size and shape of the upper rim portions and, in few instances, the depth of the tanks. All other parts and portions of such machines have little or no direct effect on the invention and can vary to a substantial extent.

In the form of the invention illustrated, the upper rim portion 18 of the tank T is substantially rectangular with straight front, rear and side edges joined by radiused corners.

The adapter unit A that I provide includes a box-like housing structure H having flat, vertical front, rear and side walls 30, 31 and 32 and flat, horizontal, vertically spaced top and bottom walls 33 and 34. The housing H has a pair of laterally spaced inside and outside flanges 35 and 36 about the perimeter of the bottom wall defining a downwardly opening channel 37 corresponding in general plan configuration with the rim portion 18 of the tank and in which said rim portion of the tank is engaged and seated. Wtih this relationship of parts, it will be apparent that the housing H is securely interengaged with and supported on and by the upper end portion of the tank T. In the case illustrated, the outer flange 35 about the perimeter of the bottom wall is established by an extension of its related front, rear and side walls of the housing.

The housing H is formed with and carries an elongate, vertically extending upwardly opening cylindrical syrup reservoir R. The reservoir R is preferably formed integrally with the bottom wall 34 of the housing and has an upper end portion projecting upwardly from the bottom wall into the interior of the housing to terminate immediately below the top wall 33. The reservoir R has a lower portion which depends freely from the bottom wall 34 and into the upper portion of the tank T and into the liquid beverage within the tank. In the preferred carrying out of my invention, and as shown in the drawings, the bottom of the reservoir R terminates in limited spaced relationship above the top of the cavity defining projection 19 on the bottom wall of the tank and in which the evaporator unit E of the refrigeration system is arranged.

The top wall 33 is a flat, horizontal plate-like part with a downwardly projecting flange 38 about its perimeter. The flange 38 engages and seats in an upwardly and outwardly opening seat 39 about the upper edges of the front, rear and side walls of the housing. The top wall is normally releasably held down and in secure engagement with the front, rear and side walls of the housing by screw fasteners 40, substantially as shown.

The top wall 33 has a vertical filler opening 42 concentric with the open top of the reservoir R and defined by a vertical annular flange 41 with an upper portion projecting above the top plane of the top wall and a lower portion which depends from the bottom plane of the top wall and is formed with a downwardly and radially outwardly disposed seat 43 which sealingly seats with an upwardly and radially inwardly disposed seat 44 formed in the upper rim of the reservoir.

The filler opening 42 is normally closed by a flat, substantially horizontal lid 45 having a pair of radially spaced concentric flanges depending from its bottom surface and defining an annular downwardly opening groove 46 in which the upper portion of the flange 41 on the top wall is engaged and seated. The lid 45 is pivotally connected with the top wall 33 by a suitable hinge means 47 (shown in part) and has an upwardly projecting manually engageable handle 48 to facilitate pivotally moving it from its normal horizontal or closed position overlying the top of the reservoir to a vertical open position and to thereby facilitate manually pouring syrup into the reservoir, from above the housing.

The several vertical walls, the bottom wall 34 and the reservoir R are preferably made of plastic and are molded as a single integrated unit. The top wall 33 and the lid 45, with its handle 48, are separate molded plastic parts. The hinge means 47 is preferably made up of related parts formed integrally with the lid and the top wall.

It will be apparent that the housing H defines a closed chamber or compartment in which yet to be described means and parts of my invention are housed and through which the upper portion of the reservoir R freely extends, for free access at the top of the housing, beneath the lid 45.

It will be further apparent that the housing H with its related lid 45 and reservoir R is such that it can be easily and conveniently manually placed in or removed from engagement over and with the upper rim portion of the tank T of the machine and is such that when engaged with the tank, it is effectively oriented and retained in position therewith.

Figure 6:
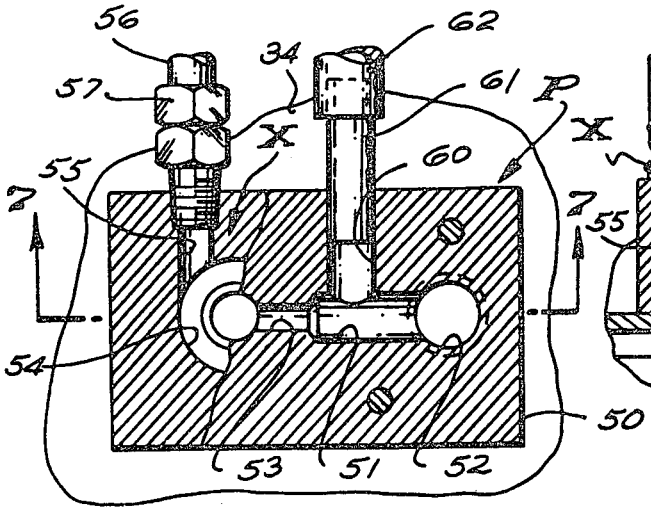
FIG. 6 is a sectional view of my proportional mixing device.
Figure 7:
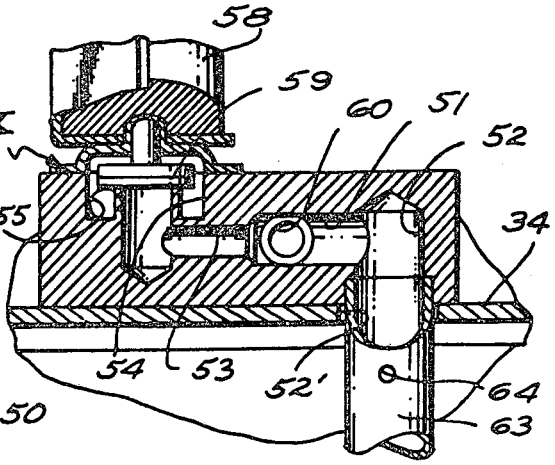
FIG. 7 is a view taken as indicated by line 7—7 on FIG. 6.

Positioned within the housing H and mounted atop the bottom wall 34 thereof, forward and to one side of the reservoir R, is an aspirator type proportional mixing device P. The device P is a standard, commercially available block-like unit which is well-known by most of those who are skilled in the art of beverage dispensing machines. Referring to FIGS. 6 and 7 of the drawings, the device P includes a block-like body 50 of plastic. The body has an elongate horizontal aspirating passage or chamber 51, a vertical downwardly opening discharge port 52 communicating with one end of the passage 51, a nozzle passage 53 concentric with and having one end communicating with the passage 51. The other end of the passage 53 communicates with a vertically upwardly opening valve chamber 54. A laterally extending water inlet port 55 communicates with the chamber 54 and is connected with a water transfer pipe or tube 56 by means of fluid fittings 57. The body 50 carries an electrical magnetic drive unit 58 which overlies and closes the chamber 54 and which carries a valve member 59. The unit 59 operates to selectively move the valve member 59 from a normal closed position on or with a valve seat formed in the chamber 54 to an open position. The chamber 54, with its valve seat, and the unit 58 and valve member 59 establish an electrically operated on and off valving means X at the upstream end of the passage 53; which controls the flow of water from the inlet port 55 to the passage 51.

The device P finally includes a lateral syrup inlet port 60 entering one side of the body and communicating with the passage 51 between the passage 53 and the port 52 and a metal coupling tube 61 in and projecting from the port 60 and engaged with the outer end of a dielectric plastic syrup conducting tube 62.

The block-like plastic body is screw-fastened to the bottom wall 33 of the housing H with its discharge port 52 registering and communicating with a through opening 52' in the bottom wall. In practice, and as shown in the drawings, a delivery tube 63 can be engaged in the port 52 to depend downwardly from the bottom wall 33 and into the beverage in the tank T to conduct beverage delivered by the unit P into the tank without undesired splashing. The delivery tube 63 is provided with an anti-syphon port 64, above the high fluid level in the tank, to prevent possible backflow of beverage through the construction.

The water transfer pipe or tube 56 extends laterally from the device P to and is connected with the outlet port or side of a manually adjustable pressure regulator M'. The pressure regulator M' is a standard commercially available regulator and is mounted on the bottom wall 33 of the housing by means of a suitable metal bracket. The regulator M' has an inlet side or port which is connected with the downstream end of an elongate water supply pipe 65, by means of suitable fittings. The pipe 65 extends rearwardly from the regulator M' through the housing H and out through an opening 66 in the rear wall of the housing to connect with a suitable pressurized commercial or domestic water service system (not shown).

The plastic syrup tube 62 extending from the metal tube 61 set and projecting from the port 60 of the device P extends to and connects with the radially outwardly projecting outer end portion of an elongate metal fluid conducting pipe or gooseneck 67 sealingly engaged in and through an opening in the side of the reservoir R, within the housing. The inner end of the pipe or gooseneck 67 extends into the tank, turns downwardly therein and is connected with the upper end of an elongate suction or draft tube 69 established of plastic or other suitable dielectric material. The lower end of the tube 69 terminates in the lower end of the reservoir R adjacent the bottom thereof and has a check-valve Z engaged in its lower end. The check-valve Z allows for free upward flow of syrup into and through the tube and prevents syrup from flowing down in that tube and back into the reservoir. Thus, the syrup tube 62 is effectively maintained filled with syrup unless and until the supply in the reservoir is exhausted.

In practice, the check-valve Z; can be a ball-type or clapper-type check-valve and can be located at any desired location between the mixing device P and the inlet end of the tube 69.

The metal coupling tube 61 and metal gooseneck 67 connected with the opposite ends of the dielectric plastic syrup tube 62 are electric terminals which are connected with a pair of electric lines 70 and 71 by suitable coupling means 72. The fluid conducting electric terminals tubes 61 and 67 cooperate with the syrup tube 62 to establish a liquid sensor means S responsive to the presence and absence of liquid or syrup in the tube 62, between the tubes 61 and 67, and which therefore operates to indicate the presence or absence of a supply of syrup in the reservoir R. In operation, so long as there is a supply of syrup in the reservoir and the tube 62 is filled with syrup, between the terminals or tubes 61 and 67, a closed circuit between the tubes 61 and 67 is mainained. When the supply of syrup in the reservoir is exhausted and the tube 62 empties, the circuit between the tubes 61 and 67 opens. Opening of that circuit is used to put the machine out of operation and can be used to trigger any desired alarm or signalling means to notify the operator of the machine that the supply of syrup is exhausted and must be replenished. For example, the noted liquid sensing means can be connected in and with a suitable disabling and signalling circuit including a relay switch 73 and a lamp 74. The lamp 74 can be mounted in the front wall 30 of the housing. (See FIG. 8 of the drawings). Disabling or shutting down of the system or structure assures that beverage in the supply tank will not be diluted by a continuing flow of water upon depletion of the supply of syrup.

The structure that I provide next includes a liquid level sensing means L carried by and depending from the bottom wall of the housing into the tank T and into the beverage therein. The means L can vary widely in form and is essentially a switching means which is a part of the above referred to circuit C. The means L operate to open or close parts or sections of the circuit C when the liquid level in the tank T drops to a predetermined low level and when the liquid level in the tank reaches a predetermined filled or high level.

In the case illustrated, the liquid level sensing means L includes a set of three laterally spaced elongate, vertical probes 80, 81 and 82. The probes are elongate metal rods with insulating jackets about their central portions and have exposed lower terminal ends 80', 81' and 82'. The upper end portions of the probes are engaged through and carried by a block-like body 83 of insulating material sealingly engaged in an opening 83' in the bottom wall 34 of the housing H. The upper ends of the probes are accessible in the interior of the housing and are suitably connected with related lines and/or conductors of the circuit C.

The lower terminal ends 80' and 82' of the probes 80 and 82 terminate at the low liquid level in the tank T and the lower terminal end 81' of the probe 81 terminates at the high liquid level in the tank T. With the above relationship of parts, the circuit between the lower terminal ends 80' and 82' of the probes 80 and 82 is normally closed by the liquid beverage in the tank T and in which the probes are immersed and is open when the liquid level in the tank drops below those probes to the predetermined low liquid level in the tank. The function of opening the circuit between terminals 80' and 82', as noted above, is utilized (through the circuit C) to effect opening the valve means X of the proportional mixing device P and to thereby cause the flow of newly constituted beverage into the tank T. The circuit between the terminals 81' and 82' of the probes 81 and 82 is normally open and remains open until the liquid level in the tank T rises to its high level and contacts the termianl 81', whereupon the circuit closes. Closing of the circuit between terminals 81' and 82' is utilized to effect closing of the valve means X of the mixing device P and to thereby shut off the flow of beverage into the tank T. Not until the circuit between terminals 80' and 82' is opened again is the noted valve means X opened again.

The circuit C can vary widely in form and construction without departing from the broad aspects and spirit of my invention. In addition to the several electric means and components described in the foregoing, which are parts of the overall circuit, the circuit C includes various components and parts which can be and which are preferably carried by a single circuit board. The circuit board can be and is shown screw-fastened to or mounted on the underside of the cover or top wall 33 of the housing H to occur within the confines of the housing.

In practice, the board that I provide carries an inexpensive, compact highly effective and dependable solid state control circuit which, while effective and suitable for use in carrying out this invention, is replete with components and parts and is capable of functions which are not required or utilized in carrying out this invention. To illustrate and describe that particular circuit board which I use would be extremely and unnecessarily burdensome and would tend to obscure the novelty of my invention. Accordingly, I have, in FIG. 8 of the drawings, diagrammatically illustrated a simple easy-to-read and understand circuit C which would be suitable and effective in carrying out my invention and which will enable anyone skilled in the art to practice the invention.

Figure 8:
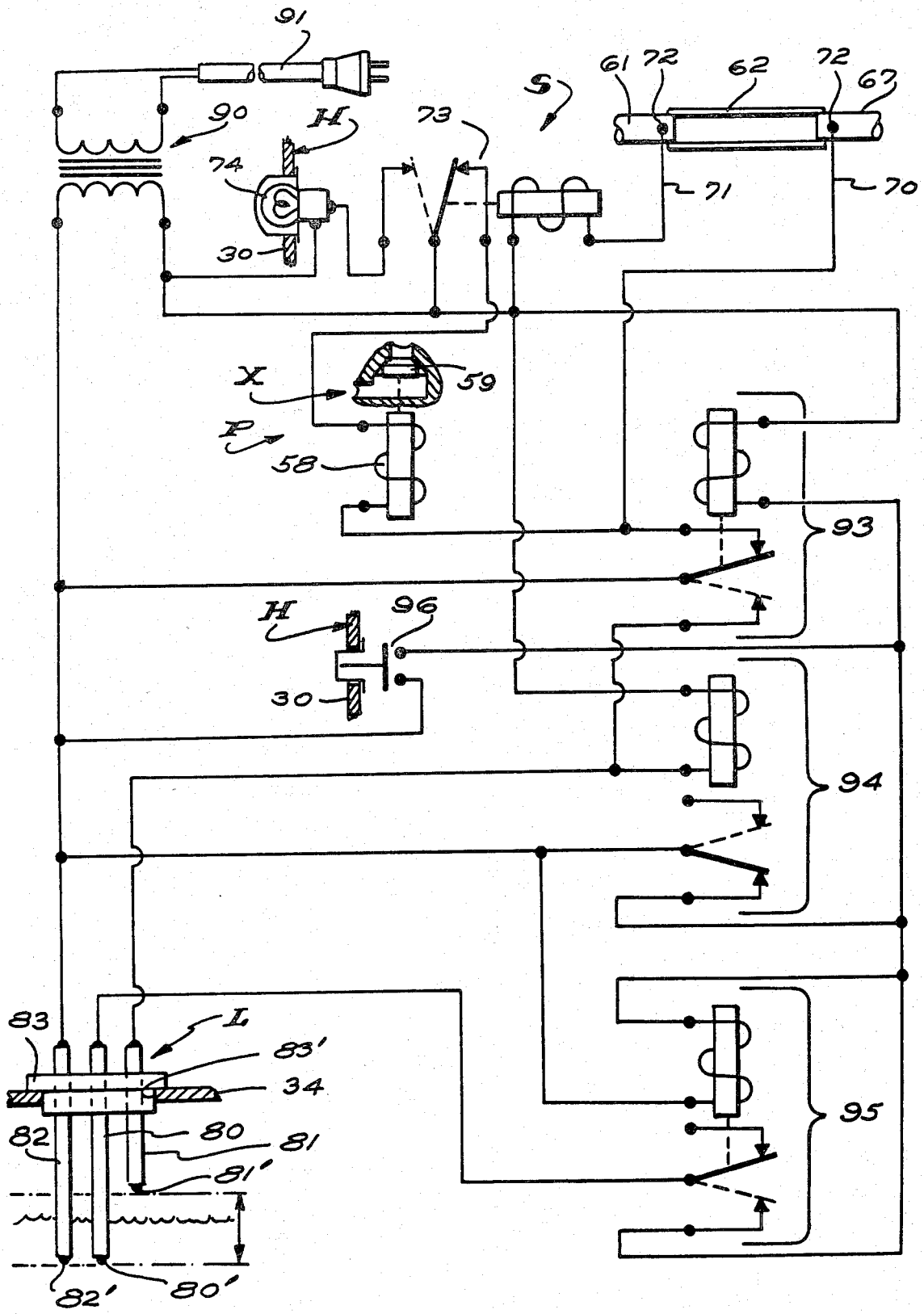
FIG. 8 is a diagram of an electric circuit.

The several means X, S and L, described above, and the principal elements and/or parts thereof are clearly illustrated and identified in FIG. 8 of the drawings.

Figure 3:
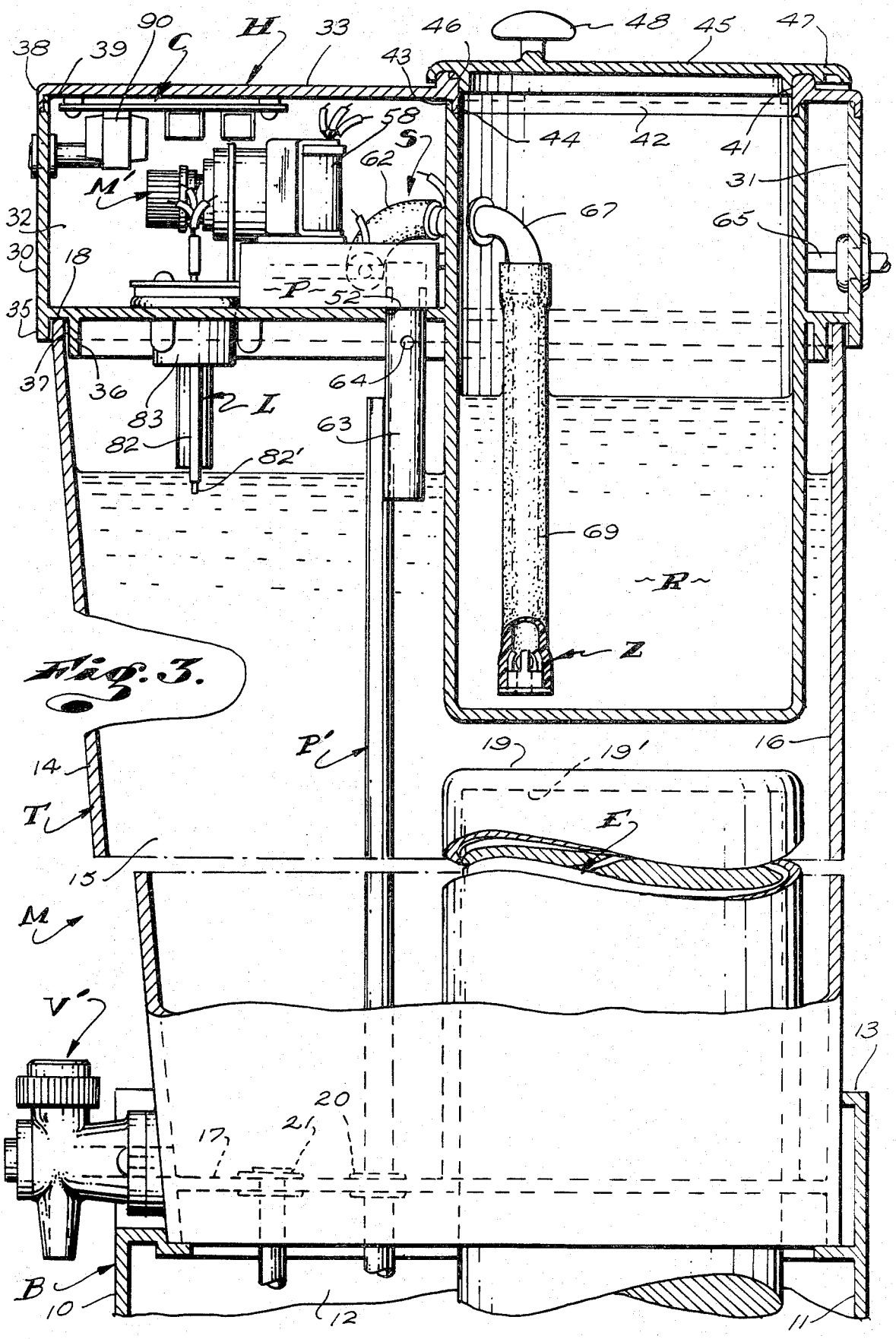
FIG. 3 is an enlarged sectional view taken substantially as indicated by line 3—3 on FIG. 2.
Figure 4:
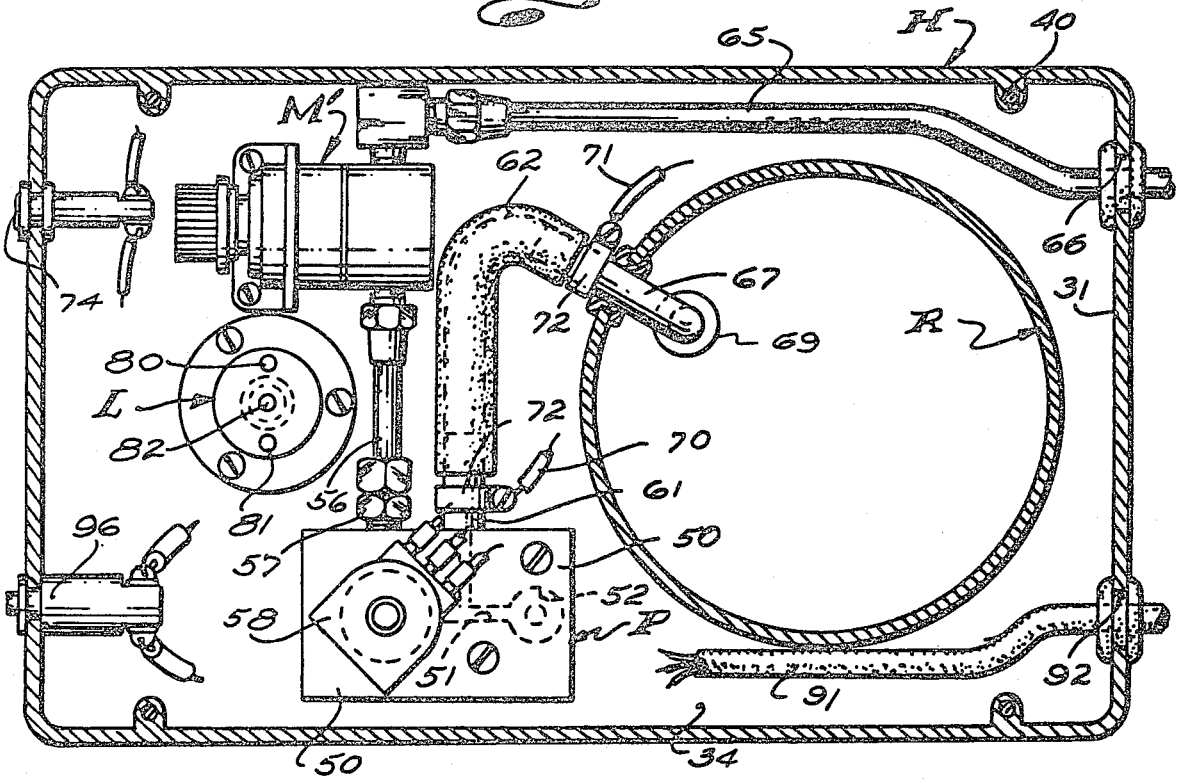
FIG. 4 is an enlarged sectional view taken substantially as indicated by line 4—4 on FIG. 2.
Figure 5:
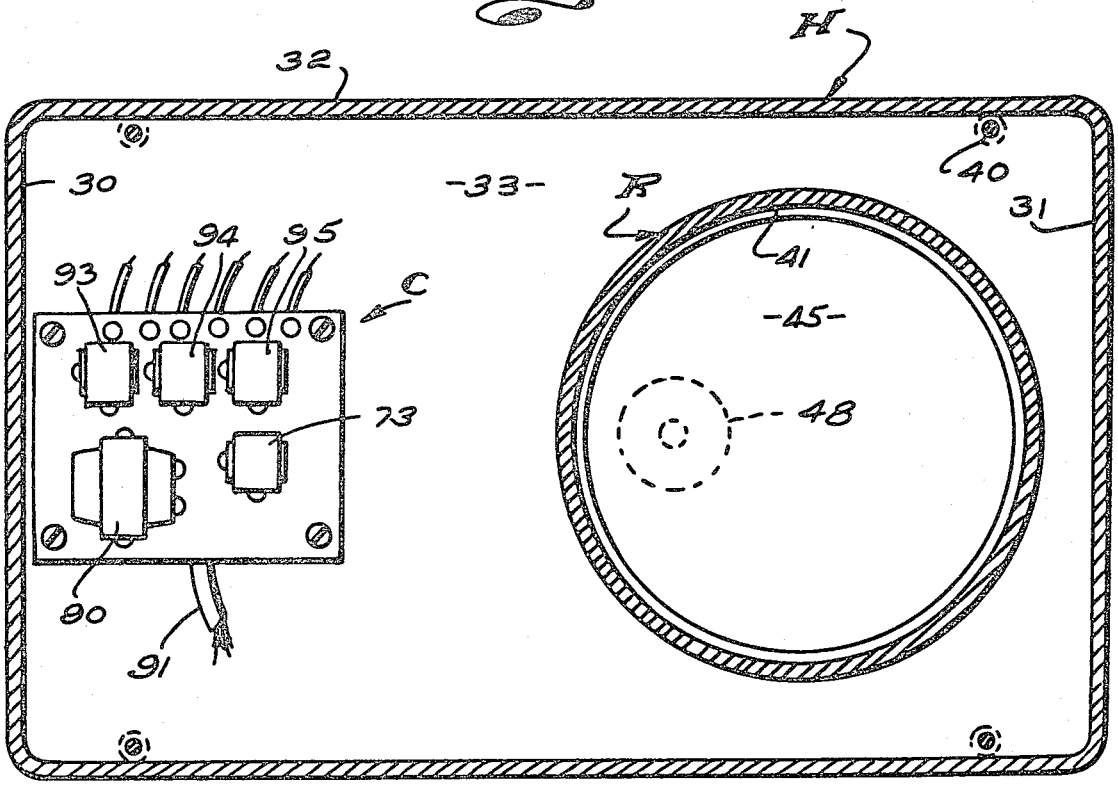
FIG. 5 is an enlarged sectional view taken substantially as indicated by line 5—5 of FIG. 2.

In addition to the above noted means X, S and L, the circuit C illustrated includes a suitable power supply 90 which is preferably a simple transformer. The power supply or transformer 90 is carried by the board and is connected with a remote power service outlet (not shown) by a service cord 91 extending rearwardly in the housing H through an opening 92 in the rear wall thereof and thence freely from the housing, as shown in FIGS. 3 and 5 of the drawings, to the noted power service outlet.

The circuit C illustrated next includes three relay switches 93, 94 and 95 which, in practice, are carried by the board. The relay switch 93 is normally open and is connected with and between the power supply and the electro-magnetic drive unit 58 of the valve means X to effect opening the valve means when the coil of that relay is energized.

It is to be noted that the probe 82 of the means L is connected with the power supply 90 and is common with respect to the probes 80 and 81.

The relay switch 93 is also connected with the coil of the relay 94 so that when the coil of the relay 93 is de-energized and the circuit to the valve means X is open, relay 94 is energized to operate it from its normal closed position to an open position. Thus, when the circuit to the valve means X is open, the relay 94 is open and vice-versa. The coil of relay 94 is also connected with probe 81 so that when the circuit between probes 81 and 82 is closed, the relay 94 opens. The relay 94 is connected in the current conducting circuit between the probe 80 and the coil of relay 93 and when opened, de-energizes the coil of and opens relay 93.

The relay 95 is normally open and is connected in the circuit supplying current to the coil of the relay 93 and in parallel with the relay 94. The operating coil of relay 95 is connected between probes 80 and 82 whereby it is energized and maintained open so long as the circuit between those probes is closed by liquid beverage in the tank T and is de-energized and closes when the liquid level drops in the tank to open the circuit between probes 80 and 82.

When relay 95 closes, relay 93 is operated to energize or open the valve means X and to de-energize and allow relay 94 to close.

With the relays 93, 94 and 95 related, as noted above, the circuit C is normally in an off or stand-by mode during which relays 94 and 95 are held open and the valve means X is maintained closed. Each time the beverage level in the tank drops below probes 80 and 82 to open the circuit therebetween, the circuit C is switched by the relay 95 to an on or filling mode, during which relay 93 is actuated to energize the unit 58 of the valve means X and cause beverage to be delivered into the tank T. When the liquid level of the beverage in the tank rises to its high level and closes the circuit between probes 81 and 82, relay 94 is operated to open and return the circuit C to its off or stand-by mode.

In practice, opening of the circuit between probes 80 and 82 to effect operation of relay 95 and closing of the circuit between probes 81 and 82 to effect operation of the relay 94 is only momentary or of very short duration.

In practice, so that the circuit C can be overridden to effect filling of the tank before low liquid level is reached, as might be desired from time to time, I provide a manually operable push-button switch 96 accessible at the front wall of the housing and connected substantially directly between the power supply and the coil of relay 93, as illustrated. Provision of the noted switch 96 is also desirable to facilitate overriding and holding the circuit C in its closed or filling mode should priming and refilling of the syrup handling structure or means between the reservoir R and mixing device P be required. Such priming might be required after the supply of syrup in the reservoir R has been exhausted and replenished and when the check-valve Z has leaked and allowed syrup in the sytem, above the reservoir, to drain back into the reservoir.

The relay valve 73 of the means S is connected in the electric circuit so that when a supply of syrup is exhausted and the relay 73 is actuated, the circuit through the valve means X of the device P is opened. Thus, the device P is shut down to prevent additional flow of water (and dilution of the beverage in the tank) until the supply of syrup is replenished.

The nature and mode of operation of the circuit of the means S, shown in FIG. 8 of the drawings, is clear from the drawing itself and requires no further description.

With the structure illustrated and described above, it will be apparent that to effect automation of a related vending machine, it is only necessary to remove the original tank cover of the machine from its related tank and replace that cover with the unit that I provide. Thereafter, it is only necessary that the service cord and water supply line or pipe exiting the rear of the housing H be connected with available power and water service outlets. No other alterations, modifications or work is required to be performed on any part or portion of the dispensing machine.

In addition to the foregoing, it might be necessary to effect adjustment of the proportional mixing device P to attain the desired proportioning of water and syrup. To effect such adjustment, access to the pressure regulator M′ is effected by removal of the top wall of the housing.

The pressure regulator M′ is manually adjustable and controls the pressure and corresponding rate of flow of the water delivered to and flowing through the device P. By adjusting the pressure of the water flowing through the device, the volumetric proportioning or ratio of water and syrup making up the beverage flowing from the device P can be effectively and accurately adjusted and set.

It will be apparent that with the invention illustrated and described, the dispensing machine with which it is related or made a part, will automatically operate to maintain the supply of beverage in the supply tank of the machine between desired set high and low levels and that the only task required of the operator of the machine is to periodically replenish the supply of syrup in the reservoir R, when the means S signals that the supply of syrup is exhausted.

Figure 2:
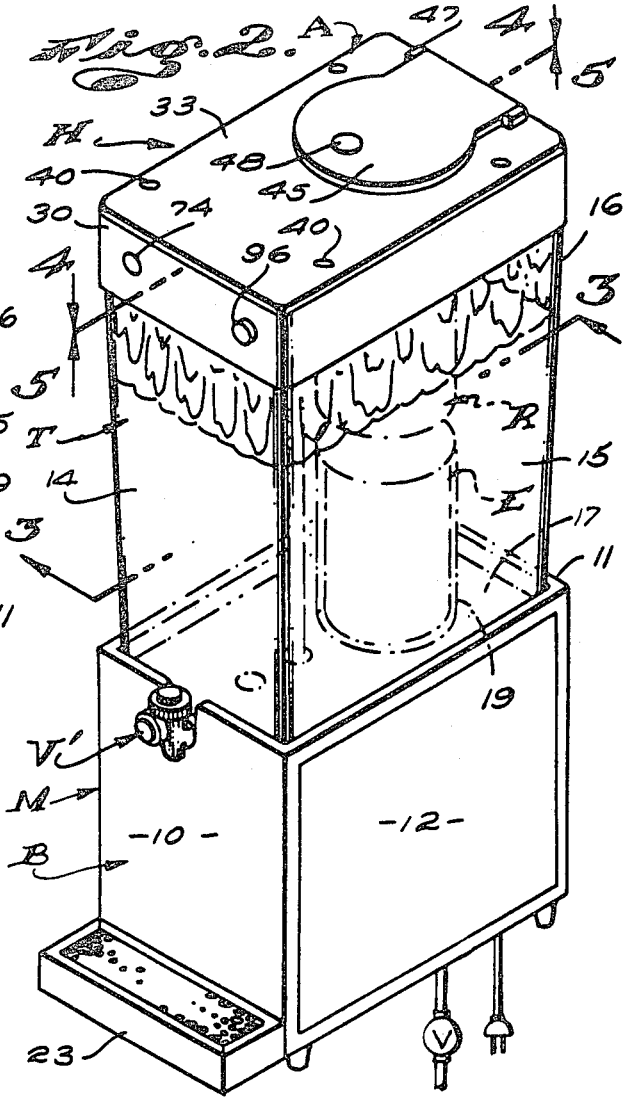
FIG. 2 is an isometric view of the machine shown in FIG. 1 with my new automating unit related to it.

In practice, the liquid level in the supply tank is maintained at a substantially constant level and is not allowed to vary an extent which will result in an appreciable change in the head pressure on the beverage at the dispensing valve of the machine. Accordingly, the dispensing valve can be a mechanically or an electrically operated, timed, portion control valve, as indicated at V′ in FIG. 2 of the drawings.

Having described only one typical preferred form and embodiment of my invention, I do not wish to be limited to the specific details herein set forth but wish to reserve to myself any modifications and/or variations that might appear to those skilled in the art and which fall within the scope of the following claims:

Having described my invention; I claim:

1. In combination, a beverage dispensing machine comprising a base engageable on a supporting structure, an upwardly opening beverage supply tank engaged atop and carried by the base and having a lower substantially horizontally base wall and vertical side walls with upper edges defining a cover engaging rim, a discharge opening at the lower end of the tank and a beverage dispensing valve connected with the discharge opening and accessible at the exterior of the machine; an automating unit to automatically mix predetermined volumes of water and beverage flavored syrup to make beverage and deliver that beverage into the tank and cyclically operable to maintain the fluid level in the tank between predetermined high and low levels, said automating unit comprises a housing with vertically spaced top and bottom walls and side walls, said bottom wall is removably positioned above the tank and has means engageable with said rim to maintain the housing positioned atop the tank, an elongate vertical upwardly opening syrup reservoir extending through said bottom wall and having a lower portion depending from that wall into the beverage in the tank and an upper portion extending up into the interior of the housing, a vertical access opening in the top wall communicates with the open top of the reservoir and a manually movable lid normally positioned at said access opening and normally overlying the reservoir, a proportional mixing device mounted within the housing to receive and mix water and syrup and to deliver it into the tank and including an aspirator unit with an elongate mixing chamber, a water nozzle passage directing water through the mixing chamber from one end thereof, a beverage outlet communicating with the other end of the mixing chamber and opening to the interior of the tank at an opening in said bottom wall and a syrup inlet communicating with the mixing chamber between the ends thereof and connected with the upper outlet end of an elongate suction tube extending into and having a lower inlet end opening at the lower portion of the reservoir, a normally closed electrically operated on and off valve with an outlet communicating with the water nozzle passage and an inlet connected with the outlet end of an elongate water supply line extending through and out of the housing, said water supply has an inlet end connected with a pressurized water supply, liquid level sensing means carried by the bottom wall and depending into the tank and including switching means actuated when the level of the beverage in the tank reaches said predetermined high and low levels and electric circuit means mounted within the housing and connected with and between the liquid level sensing means and the electrically operated valve and a power service cord connected with the electric circuit means and extending from the housing to a remote power service, said circuit operates to cause the valve to open when the switching means is actuated in response to the level of the beverage in the tank moving to said lower liquid level and to cause said valve to close when the switching means is actuated in response to the level of the beverage in the tank rising to said upper liquid level.

2. The combination set forth in claim 1 wherein the mixing device includes means upstream of the nozzle passage controlling the pressure and flow rates of water into the mixing chamber and the corresponding proportional flow of water and syrup into, through and from the device.

3. The combination set forth in claim 2 wherein said means controlling the flow of water is a manually adjustable pressure regulator.

4. The combination set forth in claim 1 which further includes signal means which emits a signal when the level of the supply of syrup in the reservoir lowers to a predetermined low level and which includes an elongate dielectric section in the suction tube, conductor parts at the opposite ends of said dielectric section and in contact with syrup in the dielectric section which syrup normally closes a circuit between the conductor parts, an electric powered signal emitter and operating circuit means are connected with and between the conductor parts; said conductor parts and operating circuit means operate to energize the emitter when insufficient syrup is in the dielectric sectin of the tube to close the circuit between the conductor parts.

5. The combination set forth in claim 1, which further includes a check-valve to stop the flow of syrup from the suction tube back into the reservoir.

6. The combination set forth in claim 1, wherein the machine includes refrigeration means to cool and maintain the beverage in the tank at a substantially consistent desired low temperature, said lower portion of the reservoir in the beverage in the tank is a heat exchange structure between the cool beverage in the tank and the syrup in the reservoir whereby syrup is maintained at a substantially constant temperature and corresponding viscosity.

7. The combination set forth in claim 1, wherein said beverage dispensing valve is a portion control valve which, upon being opened, remains open a predetermined period of time and closes automatically so as to dispense a predetermined volume of beverage.

8. The combination set forth in claim 1, which include means to open a portion of the electric circuit means supplying current to the electrically operated valve when the supply of syrup in the reservoir is exhausted and which includes spaced apart conductor parts in contact with syrup in the suction tube whereby syrup in the tube normally closes the circuit between the conductor parts, a relay switch with an operating coil series-connected with said conducting parts, said relay switch is connected in series with the electrically operated valve and operates to open when the circuit between the conducting parts opens.

* * * * *